US008700297B2

(12) United States Patent
Matsumura et al.

(10) Patent No.: US 8,700,297 B2
(45) Date of Patent: Apr. 15, 2014

(54) VEHICLE GROUP FORMING DEVICE AND VEHICLE GROUP FORMING METHOD

(75) Inventors: Takeshi Matsumura, Chofu (JP); Masato Endo, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 160 days.

(21) Appl. No.: 13/254,123

(22) PCT Filed: Mar. 5, 2009

(86) PCT No.: PCT/JP2009/054184
§ 371 (c)(1),
(2), (4) Date: Nov. 30, 2011

(87) PCT Pub. No.: WO2010/100743
PCT Pub. Date: Sep. 10, 2010

(65) Prior Publication Data

US 2012/0095671 A1 Apr. 19, 2012

(51) Int. Cl.
*G08G 1/00* (2006.01)

(52) U.S. Cl.
USPC ..... 701/117

(58) Field of Classification Search
None
See application file for complete search history.

(56) References Cited

U.S. PATENT DOCUMENTS

| | | | | |
|---|---|---|---|---|
| 6,032,097 | A * | 2/2000 | Iihoshi et al. | 701/96 |
| 2005/0222716 | A1 * | 10/2005 | Tengler et al. | 701/1 |
| 2009/0271050 | A1 * | 10/2009 | Niki et al. | 701/1 |

FOREIGN PATENT DOCUMENTS

| | | | |
|---|---|---|---|
| JP | 10-261195 | A | 9/1998 |
| JP | 2000-131085 | A | 5/2000 |
| JP | 2001-043498 | A | 2/2001 |
| JP | 2005-098749 | A | 4/2005 |
| JP | 2008-003675 | A | 1/2008 |
| JP | 2008-286671 | A | 11/2008 |
| WO | WO2008/018607 | A1 * | 2/2008 |

OTHER PUBLICATIONS

Translation of International Preliminary Report on Patentability mailed Oct. 27, 2011 from corresponding International Application No. PCT/JP2009/054184.

* cited by examiner

*Primary Examiner* — Michael J Zanelli
(74) *Attorney, Agent, or Firm* — Gifford, Krass, Sprinkle, Anderson & Citkowski, P.C.

(57) ABSTRACT

Disclosed are a vehicle group forming device and a vehicle group forming method capable of effectively using a priority lane. A vehicle group forming device which forms a vehicle group with a plurality of vehicles includes vehicle group forming means for selecting vehicles forming a vehicle group or determining the order of the vehicles on the basis of the degree of conformity to the traveling condition of a priority lane.

8 Claims, 2 Drawing Sheets

VEHICLE GROUP FORMING DEVICE AND VEHICLE GROUP FORMING METHOD

TECHNICAL FIELD

The present invention relates to a vehicle group forming device and a vehicle group forming method.

BACKGROUND ART

A study is carried out as to a case where a plurality of vehicles are traveling in the form of a vehicle group. When forming a vehicle group, the selection of vehicles forming the vehicle group or the order of the vehicles is important. In a device described in Patent Literature 1, vehicles forming a vehicle group are selected on the basis of vehicle information including the destination.

[Patent Literature 1] Japanese Unexamined Patent Application Publication No. 10-261195

[Patent Literature 2] Japanese Unexamined Patent Application Publication No. 2008-3675

SUMMARY OF INVENTION

Technical Problem

In order to reduce traffic jams, environmental load, or the like, a priority lane (for example, an HOV [High Occupancy Vehicles] lane (called a carpool lane)) in which only vehicles satisfying a predetermined traveling condition can travel has been put into practice. The predetermined traveling condition refers to a vehicle in which multiple passengers are riding, a low-environmental-load vehicle, such as a hybrid vehicle or an electric vehicle, or the like. Like the above-described device, when vehicles forming a vehicle group are selected on the basis of the destination or the like, and the vehicles enter a road in which a priority lane is set from a road in which no priority lane is set when traveling in a vehicle group, if there is a vehicle which does not conform to the traveling condition of the priority lane in the vehicle group, the vehicles in the vehicle group cannot travel in the priority lane. For this reason, it is difficult to effectively use the priority lane in the vehicle group.

Accordingly, an object of the invention is to provide a vehicle group forming device and a vehicle group forming method capable of effectively using a priority lane.

Solution to Problem

An aspect of the invention provides a vehicle group forming device which forms a vehicle group with a plurality of vehicles. The vehicle group forming device includes vehicle group forming means for selecting vehicles forming a vehicle group or determining the order of the vehicles on the basis of the degree of conformity to the traveling condition of a priority lane.

In this vehicle group forming device, the vehicle group forming means selects the vehicles forming the vehicle group or determines the order of the vehicles on the basis of the degree of conformity of each vehicle to the condition for traveling in the priority lane. In this way, in the vehicle group forming device, the vehicle group is formed taking into consideration the traveling condition of the priority lane, making it possible to effectively use the priority lane in the formed vehicle group. For example, even when the vehicles enter a road in which a priority lane is set from a road in which no priority lane is set during traveling in the vehicle group, the vehicles in the vehicle group can be traveling in the priority lane continuously. As a result, it is possible to significantly extend the traveling distance (time) in the priority lane in the vehicle group, thereby benefiting from the merit (for example, avoidance of traffic jams) of the priority lane in the vehicle group.

In the vehicle group forming device of the invention, it is preferable that the vehicle group forming means select the vehicles forming the vehicle group or determine the order of the vehicles on the basis of whether or not the vehicles conform to the traveling condition of the priority lane.

In this vehicle group forming device, the vehicle group forming means selects the vehicles forming the vehicle group or determines the order of the vehicles on the basis of whether or not each vehicle conforms to the condition for traveling in the priority lane. In this way, in the vehicle group forming device, the vehicles forming the vehicle group are determined on the basis of whether or not the vehicles conform to the traveling condition of the priority lane, thereby facilitating processing and reducing the processing load.

In the vehicle group forming device of the invention, it is preferable that the vehicle group forming means select the vehicles forming the vehicle group on the basis of the destinations of the vehicles.

In this vehicle group forming device, the vehicle group forming means selects the vehicles forming the vehicle group on the basis of the destination of each vehicle other than the traveling condition of the priority lane. In this way, in the vehicle group forming device, the vehicle group is formed taking into consideration the destination, thereby extending the traveling distance (time) in the vehicle group and further benefiting from the merit when traveling in the vehicle group.

Another aspect of the invention provides a vehicle group forming method which forms a vehicle group with a plurality of vehicles. The vehicle group forming method includes a vehicle group forming step of selecting vehicles forming a vehicle group or determining the order of the vehicles on the basis of the degree of conformity to the traveling condition of a priority lane.

In the vehicle group forming method of the invention, it is preferable that, in the vehicle group forming step, the vehicles forming the vehicle group be selected or the order of the vehicles be determined on the basis of whether or not the vehicles conform to the traveling condition of the priority lane. In the vehicle group forming method of the invention, it is preferable that, in the vehicle group forming step, the vehicles forming the vehicle group be selected on the basis of the destinations of the vehicles.

The vehicle group forming method has the same functions and effects as in the vehicle group forming device.

Advantageous Effects of Invention

According to the invention, the vehicle group is formed taking into consideration the traveling condition of the priority lane, making it possible to effectively use the priority lane in the formed vehicle group.

REFERENCE SIGNS LIST

Figure 1:
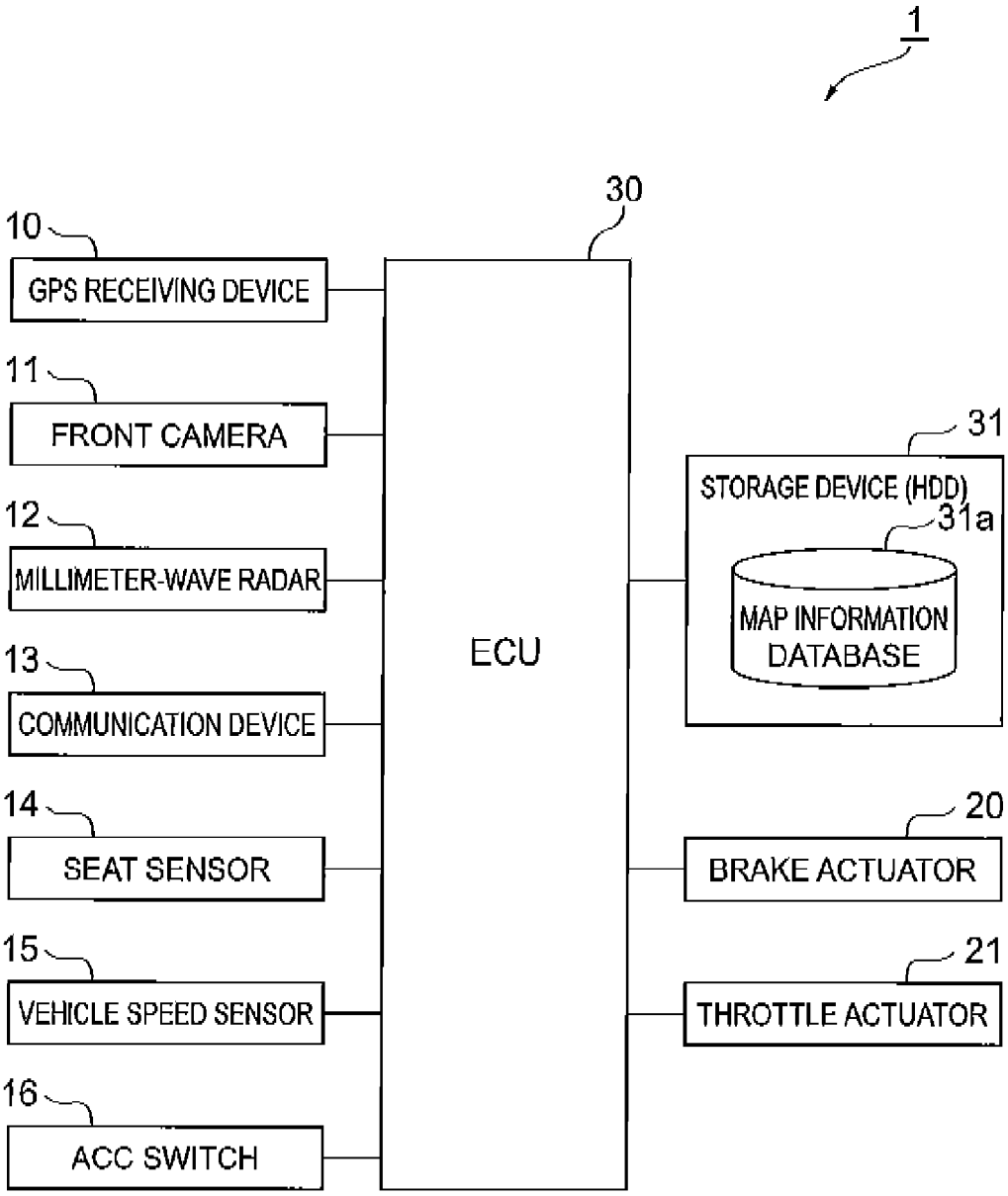
FIG. 1 is a configuration diagram of an ACC device of this embodiment.

1: ACC device, 10: GPS receiving device, 11: front camera, 12: millimeter-wave radar, 13: communication device, 14:

seat sensor, 15: vehicle speed sensor, 16: ACC switch, 20: brake actuator, 21: throttle actuator, 30: ECU, 31: storage device, 31*a*: map information database

DESCRIPTION OF EMBODIMENTS

An embodiment of a vehicle group forming device and a vehicle group forming method according to the invention will be described with reference to the drawings. In the drawings, the same or corresponding elements are represented by the same reference numerals, and overlapping description will be omitted.

In this embodiment, the invention is applied to an ACC [Adaptive Cruise Control] device which is mounted in a vehicle. The ACC device according to this embodiment controls driving force and braking force for maintaining the inter-vehicle distance or vehicle speed, and supports the accelerator operation and the brake operation of the driver. In the ACC device of this embodiment, when there is a following-target vehicle, inter-vehicle distance control (preceding vehicle following control) is performed, and when there is a following-target vehicle, constant-speed control is performed.

An ACC device 1 of this embodiment will be described with reference to FIG. 1. FIG. 1 is a configuration diagram of an ACC device of this embodiment.

If activated by the driver, the ACC device 1 selects a following-target preceding vehicle. In particular, in the ACC device 1, when a priority lane is set in a road on which a vehicle is traveling, and when the host vehicle conforms to the traveling condition of the priority lane, in order to effectively use the priority lane, a vehicle which conforms to the traveling condition of the priority lane is selected as a preceding vehicle. The traveling condition of the priority lane refers to a vehicle with two or more occupants, a low-fuel-consumption vehicle (for example, 10-mode or 15-mode fuel consumption is equal to or greater than A km/l), a low-environmental-load vehicle (for example, a hybrid vehicle), or the like. If one of the conditions is applied, a vehicle which conforms to the condition may travel in the priority lane, and if a plurality of conditions are applied, a vehicle which conforms to at least one of the conditions or a vehicle which conforms to a plurality of conditions may travel in the priority lane.

The ACC device 1 includes a GPS [Global Positioning System] receiving device 10, a front camera 11, a millimeter-wave radar 12, a communication device 13, a seat sensor 14, a vehicle speed sensor 15, an ACC switch 16, a brake actuator 20, a throttle actuator 21, an ECU [Electronic Control Unit] 30, and a storage device 31 (map information database 31*a*).

The GPS receiving device 10 is a device which estimates the current position or the like of the host vehicle using the GPS. In the GPS receiving device 10, GPS signals are received from GPS satellites through a GPS antenna for every given time and demodulated, and the current position (latitude, longitude), traveling direction, or the like of the host vehicle is calculated On the basis of demodulated position data of the GPS satellites. In the GPS receiving device 10, the current position, traveling direction, or the like of the host vehicle is transmitted to the ECU 30 as a current position signal. When a navigation system is mounted in a vehicle, the GPS receiving device of the navigation system may be shared or the current position or traveling direction (or destination) may be acquired from the navigation system.

The front camera 11 is a camera which captures an image ahead of the host vehicle. The front camera 11 is attached to the front center of the host vehicle. The front camera 11 captures an image ahead of the host vehicle for every given time, and transmits image information to the ECU 30 as an image signal.

The millimeter-wave radar 12 is a radar which detects an object using millimeter waves. The millimeter-wave radar 12 is attached to the front center of the host vehicle. The millimeter-wave radar 12 transmits millimeter waves forward of the host vehicle for every given time while scanning within the horizontal plane and receives reflected millimeter waves. The millimeter-wave radar 12 transmits transmission/reception information of the millimeter waves to the ECU 30 as a radar signal.

The communication device 13 is a wireless communication device which performs communication between vehicles. If a vehicle-to-vehicle transmission signal is received from the ECU 30, the communication device 13 modulates information included in the vehicle-to-vehicle transmission signal, and transmits the modulated signal to a vehicle within a predetermined distance. If receiving a signal from a vehicle within a predetermined distance, the communication device 13 demodulates the received signal to extract information, and transmits the information to the ECU 30 as a vehicle-to-vehicle reception signal.

The seat sensor 14 is a sensor which is provided in each seat, and detects whether or not a person takes the corresponding seat. The seat sensor 14 detects the seat pressure of the corresponding seat for every given time, and transmits the detected seat pressure to the ECU 30 as a seat pressure signal.

The vehicle speed sensor 15 is a wheel speed sensor which is provided in each wheel and detects the rotation speed of the corresponding wheel. The vehicle speed sensor 15 detects the rotation speed of the corresponding wheel for every given time, and transmits the detected rotation speed to the ECU 30 as a vehicle speed signal. The ECU 30 calculates the vehicle speed of the host vehicle from the rotation speeds of the wheels. The ECU 30 calculates acceleration or deceleration from a change over time in the vehicle speed. Acceleration (deceleration) may be detected by an acceleration sensor.

The ACC switch 16 is a switch which turns on (activates) or turns off (stops) the ACC device 1. The ACC switch 16 transmits driver's operation information to the ECU 30 as an ACC switch signal.

The brake actuator 20 is an actuator which adjusts the brake hydraulic pressure of the wheel cylinder (not shown) of each wheel. The brake actuator 20 is actuated in response to a target hydraulic pressure signal from the ECU 30 to adjust the brake hydraulic pressure of the wheel cylinder. If the target hydraulic pressure is reached, the vehicle has a target deceleration set by the ECU 30 and is at a target vehicle speed.

The throttle actuator 21 is an actuator which adjusts the opening of a throttle valve (not shown). The throttle actuator 21 is actuated in response to a target throttle opening signal from the ECU 30 to adjust the opening of the throttle valve. If the target opening is reached, the vehicle has a target acceleration set by the ECU 30 and is at a target vehicle speed.

The map information database 31*a* is constructed in a predetermined area of the storage device 31 (for example, a hard disk or the like). The map information database 31*a* stores road information, lane information, intersection shape information, and the like. The road information includes information regarding the presence/absence of a priority lane, the set section of the priority lane, the application time of the priority lane, the traveling condition of the priority lane, and the like.

The ECU 30 is an electronic control unit which has a CPU [Central Processing Unit], a ROM [Read Only Memory], a RAM [Random Access Memory], and the like, and performs overall control of the ACC device 1. When the driver turns on the ACC switch 16, the ECU 30 activates the ACC device 1 on the basis of the ACC switch signal from, the ACC switch 16. When the driver turns off the ACC switch 16 while the ACC device 1 is in operation, the ECU 30 stops the ACC device 1.

While the ACC device 1 is in operation, the ECU 30 loads various signals from various devices or sensors 10 to 16, and performs communication control, preceding vehicle selection control, preceding vehicle following control, constant-speed control, and the like on the basis of various signals. The ECU 30 sets a target acceleration/deceleration, and transmits a control signal to the brake actuator 20 or the throttle actuator 21 on the basis of the target acceleration or target deceleration. The target acceleration/deceleration is expressed by a positive value/a negative value. When the target acceleration/deceleration has a positive value, acceleration control (driving force control) by the target acceleration is performed. When the target acceleration/deceleration has a negative value, deceleration control, (braking force control) by the target deceleration is performed. In this embodiment, the preceding vehicle selection control, in the ECU 30 corresponds to vehicle group forming means described in the appended claims.

The communication control will be described. If a vehicle-to-vehicle reception signal is received from the communication device 13, the ECU 30 extracts information included in the vehicle-to-vehicle reception signal. The received vehicle-to-vehicle information includes information (for example, the number of vehicle occupants, fuel consumption information, and whether or not the vehicle is a low-environmental-load vehicle) relating to the current position and traveling direction (or destination) of another peripheral vehicle and the traveling condition of the priority lane, and the like. The ECU 30 generates information of the host vehicle to be transmitted to another peripheral vehicle, and transmits a vehicle-to-vehicle transmission signal including the information to the communication device 13. The vehicle-to-vehicle information to be transmitted includes information relating to the current position and traveling direction (or destination) of the host vehicle and the traveling condition of the priority lane, and the like. With regard to the current position or traveling direction of the host vehicle, information from the GPS receiving device 10 is used. With regard to information for determining the traveling condition of the priority lane, the number of people who are riding in the vehicle which is determined on the basis of the seat pressure from the seat sensor 14 of each seat and the specification information of the host vehicle are used. The communication control may be performed by an ECU dedicated to communication.

The preceding vehicle selection control will be described. The ECU 30 acquires information relating to the traveling condition of the priority lane for the host vehicle. Specifically, the ECU 30 acquires information regarding whether or not the host vehicle is a low-environmental-load vehicle, such as a hybrid vehicle, and 10-mode or 15-mode fuel consumption information from specification information of the host vehicle. The ECU 30 determines whether or not a passenger is in a seat on the basis of the seat pressure from the seat sensor 14, and acquires the number of people who are riding in the host vehicle.

The ECU 30 acquires information regarding a priority lane in a road (or each road to a destination), on which the host vehicle is currently traveling, from the map information database 31*a*. The ECU 30 determines whether or not the host vehicle conforms to the traveling condition of the priority lane on the basis of information relating to the traveling condition of the priority lane for the host vehicle. When a priority lane is set at a place where a vehicle is currently traveling, the determination is made under the traveling condition of the priority lane, and when no priority lane is set at a place where the vehicle is currently traveling, but a priority lane is set at a place where the vehicle will be traveling in the future, the determination is made under the traveling condition of the priority lane.

When it is determined that the host vehicle conforms to the traveling condition of the priority lane, and when a pedestrian detection mode is on, the ECU 30 turns off the pedestrian detection mode. The ECU 30 acquires information relating to the traveling condition of the priority lane for each peripheral vehicle from information of each vehicle in the periphery of the host vehicle received by the communication device 13. For each peripheral vehicle, the ECU 30 determines whether or not the peripheral vehicle conforms to the traveling condition of the priority lane (that is, determines whether or not the peripheral vehicle is under the same condition as the host vehicle) on the basis of the information relating to the traveling condition of the priority lane for the peripheral vehicle. It is preferable that a determination-target vehicle is at least a vehicle whose traveling direction is the same as the host vehicle (it is preferable that, when the destination of each vehicle is determined, the vehicles have similar destinations).

When it is determined that there is a peripheral vehicle which conforms to the traveling condition of the priority lane, the ECU 30 selects the peripheral vehicle as a following-target preceding vehicle. When there are a plurality of peripheral vehicles which conform to the condition, a vehicle which is at the closest relative distance from the host vehicle is selected (at this time, a vehicle which is ahead of the host vehicle is preferably selected). The degree of conformity to the condition for each peripheral vehicle (the degree of coincidence between the conditions of the host vehicle and the peripheral vehicle) may be calculated, the degree of conformity and the relative distance from the host vehicle may be weighted as one parameter value, and a peripheral vehicle having the highest parameter value may be selected.

When it is determined that the host vehicle does not conform to the traveling condition of the priority lane, and the pedestrian detection mode is off, the ECU 30 turns on the pedestrian detection mode. When the pedestrian detection mode is on, the sensitivity for detecting a pedestrian in the periphery of the host vehicle is improved. As a method of improving the sensitivity, a pedestrian detection range (for example, a road or the entire region of a sidewalk from near a road) increases, a threshold value for detection (for example, a threshold value of the moving speed of a pedestrian as a detection target) is lowered, or the like. As the detection method, a method in the related art is used, for example, an image captured by the front camera 11 is used, and a pedestrian is detected through pattern matching by image processing. In particular, a pedestrian who wants to carpool is detected, and when a pedestrian who wants to carpool is detected, the driver is notified. The determination on whether or not there is a person who wants to carpool is made on the basis of the posture of a pedestrian, or the like, through pattern matching. In this way, a person who wants to carpool is detected and carpool is positively carried out, such that a number of people ride in the host vehicle, and the host vehicle conforms to the traveling condition of the priority lane.

When it is determined that a vehicle has no function of detecting a pedestrian and does not conform to the traveling condition of the priority lane, the ECU 30 selects a preceding vehicle by a normal method of selecting a preceding vehicle. As the selection method, for example, it is determined whether or not there is a vehicle as a following target ahead of the host vehicle on the basis of transmission/reception information from the millimeter-wave radar 12, and when there is a vehicle as a following target ahead of the host vehicle, the preceding vehicle is selected. When no priority lane is set in a road on which the host vehicle is traveling or a traveling destination road, a preceding vehicle is selected by the method of selecting a preceding vehicle in the related art.

The preceding vehicle following control will be described. When a preceding vehicle is selected, the ECU 30 calculates the inter-vehicle distance between, the selected preceding vehicle and the host vehicle on the basis of a radar signal, and calculates the relative speed between the host vehicle and the preceding vehicle from a change over time in the inter-vehicle distance. The ECU 30 divides the inter-vehicle distance to the preceding vehicle by the relative speed, and sets the division value as TTC [Time To Collision]. TTC represents the time until the host vehicle reaches the preceding vehicle. The ECU 30 sets a target acceleration/deceleration necessary for adjusting the TTC with the preceding vehicle to a target TTC. When the target acceleration/deceleration has a positive value, the ECU 30 sets a target acceleration, sets the target opening of the throttle valve necessary for obtaining the target acceleration, and transmits the target opening to the throttle actuator 21 as a target throttle opening signal. When the target acceleration/deceleration has a negative value, the ECU 30 sets a target deceleration, sets the brake hydraulic pressure of the wheel cylinder of each wheel necessary for obtaining the target deceleration, and transmits the brake hydraulic pressure to the brake actuator 20 as a target hydraulic pressure signal. The target TTC may be a fixed value set in advance or may be a variable value based on the host vehicle speed or the like set using a map or the like.

The constant-speed control will be described. When a preceding vehicle is not selected, the ECU 30 sets a target acceleration/deceleration necessary for adjusting the host vehicle speed to the target vehicle speed on the basis of a difference between the host vehicle speed calculated on the basis of information from the vehicle speed sensor 15 and the target vehicle speed for every given time. The processing for adjusting the acceleration/deceleration of the host vehicle to the target acceleration/deceleration is the same processing as the preceding vehicle following control. The target vehicle speed may be set by the driver, for example, using a function in the ACC switch 16 or the host vehicle speed when the ACC device 1 is activated may be set.

Figure 2:
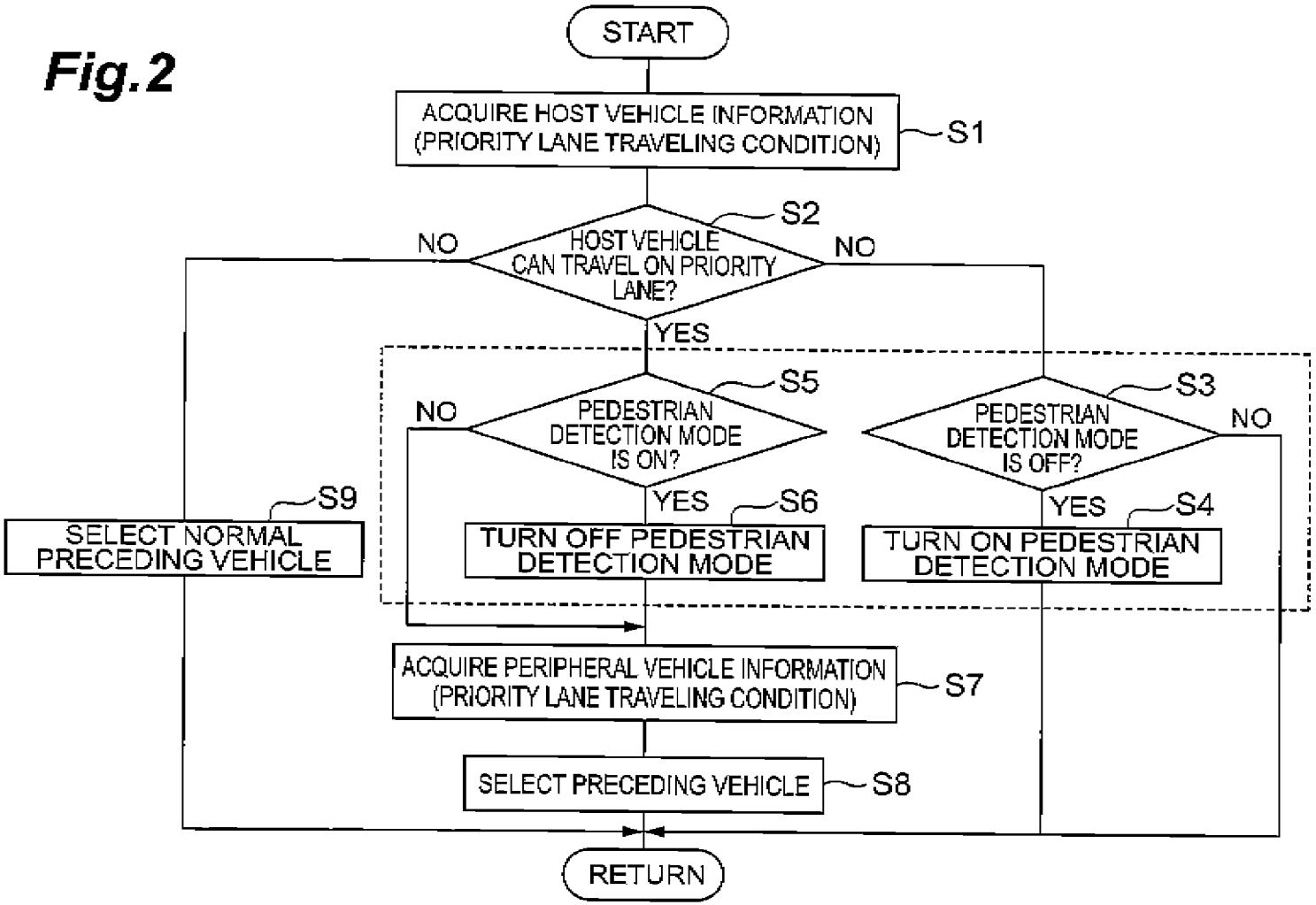
FIG. 2 is a flowchart showing a flow of preceding vehicle selection control in an ECU of FIG. 1.

The operation of the ACC device 1 will be described with reference to FIG. 1. In particular, the preceding vehicle selection, control in the ECU 30 will be described with reference to a flowchart of FIG. 2. FIG. 2 is a flowchart showing a flow of preceding vehicle selection control in the ECU of FIG. 1.

The GPS receiving device 10 receives GPS information from the GPS satellites for every given time, calculates the current position or the like on the basis of the GPS information, and transmits the current position to the ECU 30 as a current position signal. The front camera 11 captures an image ahead of the host vehicle for every given time and transmits image information to the ECU 30 as an image signal. The millimeter-wave radar 12 transmits and receives millimeter waves for every given time and transmits the transmission and reception information to the ECU 30 as a radar signal.

If a signal is transmitted from a vehicle within a predetermined distance, the communication device 13 receives the signal from the vehicle, demodulates the signal to extract information, and transmits the information to the ECU 30 as a vehicle-to-vehicle reception signal. If a vehicle-to-vehicle transmission signal is received from the ECU 30, the communication device 13 modulates information in the vehicle-to-vehicle transmission signal, and transmits the modulated signal to a vehicle within a predetermined distance.

The seat sensor 14 of each seat detects the seat pressure of the seat for every given time and transmits the detected seat pressure to the ECU 30 as a seat pressure signal. The vehicle speed sensor 15 of each wheel detects the rotation speed of the wheel for every given time and transmits the rotation speed to the ECU 30 as a vehicle speed signal.

The ACC switch 16 transmits driver's operation information to the ECU 30 as an ACC switch signal. If it is determined on the basis of the ACC switch signal that the driver carries out an operation to turn on the ACC switch 16, the ECU 30 activates the ACC device 1 and repeatedly performs the following processing for every given time.

The ECU 30 acquires information relating to the traveling condition of a priority lane for the host vehicle from the specification information of the host vehicle or the seat pressure information from the seat sensor 14 of each seat (S1). The ECU 30 acquires information regarding a road on which the host vehicle is currently traveling or a priority lane as a traveling destination, from the map information database 31*a*. The ECU 30 determines whether or not the host vehicle can travel in the priority lane (S2).

When it is determined in S2 that the host vehicle can not travel in the priority lane, the ECU 30 determines whether or not the pedestrian detection mode is off (S3). When it is determined in S3 that the pedestrian detection mode is off, the ECU 30 turns on the pedestrian detection mode and ends the current preceding vehicle selection control (S4). When it is determined in S3 that the pedestrian detection mode is on, the ECU 30 ends the current preceding vehicle selection control. In this case, since the pedestrian detection mode is on, the detection sensitivity of a pedestrian (in particular, a person who wants to carpool) increases. For this reason, if a person who wants to carpool is detected through pedestrian detection, the driver is notified, and the person who wants to carpool rides on the host vehicle, such that the host vehicle can travel in the priority lane.

When it is determined in S2 that the host vehicle can travel in the priority lane, the ECU 30 determines whether or not the pedestrian detection mode is on (S5). When it is determined in S5 that the pedestrian detection mode is on, the ECU 30 turns of the pedestrian detection mode (S6). The ECU 30 acquires information relating to the traveling condition of the priority lane for each peripheral vehicle from information of each vehicle in the periphery of the host vehicle received by the communication device 13 (S7). The ECU 30 determines whether or not each peripheral vehicle can travel in the priority lane, selects as a preceding vehicle another optimum vehicle from peripheral vehicles which can travel in the priority lane, and ends the current preceding vehicle selection control (S8).

In a vehicle which has no function of detecting a pedestrian, when it is determined in S2 that the host vehicle cannot travel in the priority lane, the ECU 30 selects a preceding vehicle by a normal method (S9).

When a preceding vehicle is selected, the ECU 30 calculates the inter-vehicle distance or relative speed between the selected preceding vehicle and the host vehicle on the basis of the transmission/reception information of the millimeter-wave radar 12. The ECU 30 divides the inter-vehicle distance to the preceding vehicle by the relative speed and calculates the TTC. The ECU 30 sets the target acceleration/deceleration necessary for adjusting the TTC to the target TTC. When the target acceleration/deceleration has a positive value, the ECU 30 transmits a target throttle opening signal for obtaining a target acceleration to the throttle actuator 21. If the target throttle opening signal is received, the throttle actuator 21 is actuated in response to the target throttle opening signal and adjusts the opening of the throttle valve. If the target throttle opening is reached, the host vehicle has the target acceleration and is at the target vehicle speed. When the target acceleration/deceleration has a negative value, the ECU 30 transmits a target hydraulic pressure signal for obtaining a target deceleration to the brake actuator 20. If the target hydraulic pressure signal is received, the brake actuator 20 is actuated in response to the target hydraulic pressure signal and adjusts the brake hydraulic pressure of the wheel cylinder. If the target hydraulic pressure is reached, the host vehicle has the target deceleration and is at the target vehicle speed. Thus, in the host vehicle, the TTC to the preceding vehicle is adjusted to the target TTC.

When a preceding vehicle cannot be selected, the ECU 30 sets the target acceleration/deceleration necessary for adjusting the host vehicle speed based on information from the vehicle speed sensor 15 to the target vehicle speed. In the ECU 30, the throttle actuator 21, and the brake actuator 20, the same operations as described above are performed on the basis of the target acceleration/deceleration. Thus, in the host vehicle, the host vehicle speed is adjusted to the target vehicle speed.

According to the ACC device 1, a preceding vehicle is selected taking into consideration the traveling condition of the priority lane, making it possible to effectively use the priority lane during following the preceding vehicle. For example, even, when vehicles enters a road on which a priority lane is set from a road on which no priority lane is set during following, since vehicles which conform to the traveling condition of the priority lane are following each other, the vehicles can travel in the priority lane while continuing following. As a result, it is possible to significantly extend the traveling distance (time) in the priority lane during following, thereby benefiting from the merit (for example, avoidance of traffic jams) of the priority lane.

Although the embodiment of the invention has been described, the invention is not limited to the above-described embodiment, and can be carried out in various forms.

For example, although in this embodiment, the invention is applied to an ACC device which is mounted in a vehicle, and the vehicle group forming method of the invention is used to select a following-target preceding vehicle, the invention may be applied to another device which forms a vehicle group with a plurality of vehicles or may be applied to a roadside device which performs overall control of vehicles in a predetermined region.

Although in this embodiment, a configuration has been made in which a preceding vehicle (a vehicle which will form a vehicle group) is selected in accordance with whether or not a vehicle conforms to the traveling condition of the priority lane, a configuration may be made in which vehicles which will form a vehicle group are selected on the basis of the degree of conformity to the traveling condition of the priority lane. For example, when the traveling condition of the priority lane refers to a vehicle with three or more occupants, the degree of conformity is set for a single-seat vehicle, a two-seat vehicle, and a three-seat or more vehicle, a vehicle having a high degree of conformity is selected. A configuration may also be made in which the traveling order of vehicles forming a vehicle group is determined on the basis of the degree of conformity to the traveling condition of the priority lane. For example, it is assumed that the traveling condition of the priority lane is that a predetermined fuel consumption condition is satisfied. A vehicle having a substantially rectangular parallelepiped shape, such as a minivan, has high air resistance, and a streamlined vehicle, such as a sports car, has low air resistance. Thus, when forming a vehicle group with these vehicles, the order of the vehicle group is determined such that a streamlined vehicle having excellent fuel consumption is arranged at the head, and a vehicle having a substantially rectangular parallelepiped shape is arranged at the back of the streamlined vehicle (in the vehicle having a substantially rectangular parallelepiped shape, since there is a vehicle ahead, air resistance is lowered). Therefore, fuel consumption as the whole vehicle group can be improved, and the predetermined fuel consumption, condition can be satisfied.

Although in this embodiment, a configuration has been made in which at least a vehicle which has the same traveling direction rather than the traveling condition of the priority lane is selected as a following-target preceding vehicle, a configuration may be made in which vehicles forming a vehicle group are selected on the basis of at least the destination other than the traveling condition of the priority lane. When a vehicle group is formed with vehicles which have similar destinations, it is possible to extend the traveling distance (time) in the vehicle group, thereby further benefiting from the merit when traveling in the vehicle group.

Although in this embodiment, a configuration has been, made in which it is determined whether or not there is a passenger on each seat on the basis of the detection result of the seat sensor, the determination may be made using images captured by an in-vehicle camera, a direct input of the driver, or the like.

Although in this embodiment, a case has been described where the host vehicle selects a preceding vehicle, and following is performed between the two vehicles, the invention may be applied to a case where the host vehicle is selected as a following-target preceding vehicle, or a preceding vehicle selects a vehicle ahead as a following-target preceding vehicle, and following is performed between other vehicles, such that following is performed between three or more vehicles.

Although in this embodiment, a configuration has been made in which, when the host vehicle conforms to the traveling condition of the priority lane, the pedestrian detection mode is off, even when the host vehicle conforms to the traveling condition of the priority lane, the pedestrian detection mode may be on, and a person who wants to carpool may be positively detected.

Although in this embodiment, a configuration has been made in which information of peripheral vehicles are acquired through vehicle-to-vehicle communication, when information cannot be acquired through vehicle-to-vehicle communication, the types of the peripheral vehicles or the number of people who are riding may be recognized on the basis of images captured by a camera.

The invention claimed is:

1. A vehicle group forming device which forms a vehicle group with a plurality of vehicles, the vehicle group forming device comprising:

an ECU for determining whether or not a host vehicle conforms to the traveling condition of a priority lane, and when it is determined that the host vehicle conforms to the traveling condition of the priority lane, determining whether or not other vehicles in a periphery of the host vehicle conforms to the traveling condition of the priority lane and selecting as a vehicle forming a vehicle group a vehicle at a closest relative distance from the host vehicle or a vehicle having a highest parameter value based on the degree of conformity to the traveling condition and the relative distance from the host vehicle from among the other vehicles which conform to the condition, wherein the ECU determines the host vehicle or the other vehicles conform to the traveling condition of the priority lane when the host vehicle or the other vehicles are at least one of a vehicle with a predetermined number or more occupants, a low-fuel consumption vehicle and a low-environmental-load vehicle.

2. The vehicle group forming device according to claim 1, wherein the ECU forms the vehicle group so that a vehicle with low air resistance is arranged at the head of the vehicle group.

3. The vehicle group forming device according to claim 2, further comprises a pedestrian detection unit for detecting a pedestrian, wherein when the ECU determines the host vehicle does not conform to the traveling condition of the priority lane, the ECU detects a pedestrian who wants to carpool with the host vehicle by the pedestrian detection unit.

4. The vehicle group forming device according to claim 1, further comprising a pedestrian detection unit for detecting a pedestrian, wherein when the ECU determines the host vehicle does not conform to the traveling condition of the priority lane, the ECU detects a pedestrian who wants to carpool with the host vehicle by the pedestrian detection unit.

5. A vehicle group forming method which forms a vehicle group with a plurality of vehicles, the vehicle group forming method comprising:

determining by an ECU whether or not a host vehicle conforms to the traveling condition of a priority lane, and when it is determined that the host vehicle conforms to the traveling condition of the priority lane, determining whether or not other vehicles in a periphery of the host vehicle conforms to the traveling condition of the priority lane and selecting as a vehicle forming a vehicle group a vehicle at a closest relative distance from the host vehicle or a vehicle having a highest parameter value based on the degree of conformity to the traveling condition and the relative distance from the host vehicle from among the other vehicles which conform to the condition, wherein the ECU determines the host vehicle or the other vehicles conform to the traveling condition of the priority lane when the host vehicle or the other vehicles are at least one of a vehicle with a predetermined number or more occupants, a low-fuel consumption vehicle and a low-environmental-load vehicle.

6. The vehicle group forming method according to claim 5, wherein the ECU forms the vehicle group so that a vehicle with low air resistance is arranged at the head of the vehicle group.

7. The vehicle group forming method according to claim 6, wherein when the ECU determines the host vehicle does not conform to the traveling condition of the priority lane, the ECU detects a pedestrian who wants to carpool with the host vehicle by a pedestrian detection unit.

8. The vehicle group forming method according to claim 5, wherein when the ECU determines the host vehicle does not conform to the traveling condition of the priority lane, the ECU detects a pedestrian who wants to carpool with the host vehicle by a pedestrian detection unit.

* * * * *